US009623582B2

(12) United States Patent
Mori et al.

(10) Patent No.: US 9,623,582 B2
(45) Date of Patent: Apr. 18, 2017

(54) CARRIER-TAPE FABRICATION DIE AND CARRIER-TAPE FABRICATION METHOD

(71) Applicant: MURATA MANUFACTURING CO., LTD., Kyoto (JP)

(72) Inventors: Haruhiko Mori, Kyoto (JP); Hisashi Yoshika, Kyoto (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 364 days.

(21) Appl. No.: 14/104,910

(22) Filed: Dec. 12, 2013

(65) Prior Publication Data

US 2014/0165802 A1 Jun. 19, 2014

(30) Foreign Application Priority Data

Dec. 14, 2012 (JP) ..... 2012-272919

(51) Int. Cl.
*B26D 1/00* (2006.01)
*B26F 1/14* (2006.01)
*B26F 1/44* (2006.01)

(52) U.S. Cl.
CPC ..... *B26F 1/14* (2013.01); *B26F 2001/4481* (2013.01); *Y10T 83/04* (2015.04); *Y10T 83/9425* (2015.04)

(58) Field of Classification Search
CPC ..... B26F 1/14; B26F 2001/4481; Y10T 83/9425; Y10T 83/04
USPC ..... 83/13, 685–691
See application file for complete search history.

(56) References Cited

U.S. PATENT DOCUMENTS 3,143,026 A * 8/1964 Akerson ..... B27M 1/04 83/686
3,504,588 A * 4/1970 Thomas ..... B26F 1/14 83/685
4,898,056 A 2/1990 Brobb et al.
(Continued)

FOREIGN PATENT DOCUMENTS

JP H07-112399 A 5/1995
JP H07-136991 A 5/1995
JP 2003-334795 A 11/2003

OTHER PUBLICATIONS

An Office Action; "Notice of Reasons for Rejection," issued by the Japanese Patent Office on Nov. 11, 2014, which corresponds to Japanese Patent Application No. 2012-272919 and is related to U.S. Appl. No. 14/104,910; with English language translation.

*Primary Examiner* — Omar Flores Sanchez
(74) *Attorney, Agent, or Firm* — Studebaker & Brackett PC

(57) ABSTRACT

A die for fabricating a carrier tape such that the carrier tape is provided with a plurality of housing holes for housing electronic components therein in a state where the housing holes are arranged in a longitudinal direction and penetrates the carrier tape in a thickness direction. The die is less prone to be damaged and is less prone to induce breakages in the interval portions between the housing holes in the carrier tape. A male die includes housing-hole formation convex portions which are constituted by a plurality of first housing-hole formation convex portions having respective tip ends at a relatively-higher heightwise position, and a plurality of second housing-hole formation convex portions having respective tip ends at a relatively-lower heightwise position.

7 Claims, 12 Drawing Sheets

(56) References Cited

U.S. PATENT DOCUMENTS

| | | | | |
|---|---|---|---|---|
| 6,408,728 | B1 * | 6/2002 | Tsuji | B26D 7/2614<br>83/687 |
| 6,606,926 | B1 * | 8/2003 | Tsuji | B26F 1/02<br>83/13 |
| 6,766,723 | B2 * | 7/2004 | Yasoda | B26F 1/04<br>83/405 |
| 6,877,408 | B2 * | 4/2005 | Kubota | B26D 5/08<br>83/248 |
| 2005/0081695 | A1 | 4/2005 | Lee | |

* cited by examiner

CARRIER-TAPE FABRICATION DIE AND CARRIER-TAPE FABRICATION METHOD

CROSS REFERENCE TO RELATED APPLICATIONS

This application claims benefit of priority to Japanese Patent Application No. 2012-272919 filed Dec. 14, 2012, the entire content of which is incorporated herein by reference.

TECHNICAL FIELD

The technical field relates to carrier-tape fabrication dies for use in fabricating carrier tapes provided with a plurality of housing holes for housing electronic components therein in states where the housing holes are arranged in the longitudinal direction and penetrate the carrier tapes in the thickness direction, from tape materials made of cardboard, for example. Further, the present disclosure relates to carrier-tape fabrication methods implemented using the same.

BACKGROUND

For example, JP-A No. 2003-334795 describes a carrier tape and a die for use in fabricating the carrier tape, as a technique of interest regarding the present disclosure. At first, with reference to FIG. 14, the carrier tape described in JP-A No. 2003-334795 will be described.

The carrier tape 1 is provided with a plurality of housing holes 2 arranged at even intervals in the longitudinal direction. The housing holes 2 are for housing a single chip-type electronic component (not illustrated in FIG. 14) within each housing hole 2 and are provided in the carrier tape 1 in a state where the housing holes 2 penetrate the carrier tape 1 in the thickness direction. Although not illustrated in FIG. 14, a top tape and a bottom tape are attached to the upper surface and the lower surface of the carrier tape 1, respectively, in order to prevent the electronic components housed within the housing holes 2 from falling out therefrom.

The carrier tape 1 includes a plurality of feeding holes 3 arranged in parallel with the direction of the arrangement of the plurality of housing holes 2. The feeding holes 3 are arranged at even intervals at a rate of a single feeding hole per a few housing holes 2. The top tape and the bottom tape are adapted not to cover the feeding holes 3.

As described above, a single electronic component is housed within each housing hole 2 and, also, the top tape and the bottom tape are attached to the carrier tape 1, which forms a series of electronic components in a state where the plurality of electronic components are in a row.

In a process for mounting electronic components, the series of the electronic components including the carrier tape 1 is intermittently transferred by the feeding holes 3, the top tape is stripped off from the carrier tape 1 at a predetermined pickup position, and the electronic components within the housing holes 2 are picked up through vacuum suction, for example, and are supplied to a predetermined mounting position.

With reference to FIGS. 15 to 17, there will be described a carrier-tape fabrication die 4 for fabricating the carrier tape 1. The carrier-tape fabrication die 4 includes a male die 5 and a female die 6 which are provided such that they can be brought close to each other and can be separated from each other. The male die 5 and the female die 6 are illustrated in FIG. 17 and the female die 6 is solely illustrated in FIGS. 15 and 16. At first, the female die 6 will be mainly described, with reference to FIGS. 15 and 16.

The female die 6 includes a plurality of housing-hole formation concave portions 7 and a plurality of feeding-hole formation concave portions 8, as illustrated in FIG. 15. The housing-hole formation concave portions 7 and the feeding-hole formation concave portions 8, which are for forming the housing holes 2 and the feeding holes 3, respectively, described above, are arranged in a distribution state which corresponds to the positions of the housing holes 2 and the feeding holes 3 to be formed.

The female die 6 has a three-split structure and is constituted by three members 9 to 11, as illustrated in FIG. 16. The housing-hole formation concave portions 7 are formed from the combination of these three members 9 to 11.

The first member 9 has a first side surface 12 which provides a first wall surface defining the housing-hole formation concave portions 7. Further, the first member 9 is provided with the feeding-hole formation concave portions 8. The second member 10 has an L-shaped cross section and provides wall portions between respective adjacent housing-hole formation concave portions 7, namely inter-concave-portion wall portions 13. The third member 11 has a second side surface 14 which provides a second wall surface faced to the first wall surface which is provided by the first side wall 12 and defines the housing-hole formation concave portions 7.

The combination of these first to third members 9 to 11 as illustrated in FIG. 15 forms the female die 6. In the female die 6, the housing-hole formation concave portions 7 are defined by the side surface 12 in the first member, the inter-concave-portion wall portions 13 in the second member 10, and the side surface 14 in the third member 11. The combination of the first to third members 9 to 11 is employed for forming the housing-hole formation concave portions 7 as described above, in order to make the housing-hole formation concave portions 7 have an accurate rectangular lateral cross-sectional shape and, therefore, in order to make the housing holes 2 formed thereby have an accurate rectangular lateral cross-sectional shape.

When the housing holes 2 have such an accurate rectangular lateral cross-sectional shape, it is possible to stably house chip-type electronic components therein and, also, it is possible to smoothly pick up the electronic components therefrom, without necessitating significantly increasing the gaps between the inner peripheral surfaces of the housing holes 2 and the outer peripheral surfaces of the chip-type electronic components housed therein.

Further, in the case where the combination of the first to third members 9 to 11 is not employed for forming the housing-hole formation concave portions 7, it is unavoidable that larger or smaller radii of curvature are formed at the corner portions of the rectangular shape of the housing-hole formation concave portions 7, due to problems in the working. On the other hand, the feeding-hole formation concave portions 8 have a circular lateral cross-sectional shape and, therefore, can be easily formed by working and, therefore, the feeding-hole formation concave portions 8 can be simply formed in the first member 9.

As illustrated in FIG. 17, the male die 5 includes a plurality of housing-hole formation convex portions arranged therein. The housing-hole formation concave portions 7 provided in the female die 6 are to receive the housing-hole formation convex portions 15. Further, although not illustrated in FIG. 17, the male die 5 is provided with a plurality of protruding feeding-hole formation pins, which correspond to the plural feeding holes 3 to be formed. The feeding-hole formation pins are received by the feeding-hole formation concave portions 8 in the female die 6.

As illustrated in FIG. 17(A), in order to fabricate the carrier tape 1, a tape material 16 made of a cardboard, for example, is prepared, and the tape material 16 is placed between the male die 5 and the female die 6. Further, it should be noted that, in FIG. 17, the tape material 16 is illustrated with exaggeration in its thickness dimension. Exaggeration is given similarly in the other drawings illustrating the cross section of the tape material.

Next, as illustrated in FIG. 17(B), the male die 5 and the female die 6 are brought close to each other. Thus, the housing-hole formation convex portions 15 are fitted into the housing-hole formation concave portions 7 while punching portions of the tape material 16, thereby forming housing holes 2 in the tape material 16. In FIG. 17(B), broken lines indicate the punched pieces 17 resulted from the punching on the tape material 16, as a result of the formation of the housing holes 2.

Further, although not illustrated in FIG. 17(B), when the male die 5 and the female die 6 are brought close to each other with the tape material 16 sandwiched therebetween, as described above, the feeding-hole formation pins are fitted into the feeding-hole formation concave portions 8 while punching portions of the tape material 16, thereby further forming feeding holes 3 in the tape material 16.

Next, as illustrated in FIG. 17(C), the male die 5 and the female die 6 are returned to a state where they are separated from each other. A plurality of housing holes 2 and a plurality of feeding holes 3, which are not illustrated in the figure, have been formed in the tape material 16 placed on the female die 6.

Next, the tape material 16 is transferred by a predetermined distance in the longitudinal direction, through the feeding holes 3. Further, the respective processes illustrated in FIGS. 17(A) to 17(C) are repeated by interposing the process for transferring the tape material 16 in the longitudinal direction by the predetermined distance, so that the carrier tape 1 as illustrated in FIG. 14 is fabricated.

SUMMARY

In recent years, as size reduction in electronic components has been further advanced, the housing holes formed in carrier tapes have been also reduced in size and, along therewith, the pitches of arrangements of the housing holes have been reduced, in order to increase the number of electronic components housed therein per unit length.

FIG. 18 illustrates a carrier tape 21 adapted to size reduction in electronic components as described above. The carrier tape 21 has a plurality of housing holes 22 arranged in the longitudinal direction and, further, has a plurality of feeding holes 23 arranged in parallel with the direction of the arrangement of the plurality of the housing holes 22. The feeding holes 23 are arranged at even intervals at a rate of a single feeding hole per four housing holes 22, for example.

The carrier tape 21 is formed from a tape material made of a resin-impregnated cardboard with a thickness of about 0.5 mm, for example. As examples of dimensions thereof, the housing holes 22 have a dimension L1 of about 0.6 mm which is measured in the direction of the arrangement (the longitudinal direction of the carrier tape 21), and a dimension L2 of about 1.1 mm which is measured in the direction orthogonal to the direction of the arrangement, and the arrangement pitch P of the housing holes 22 is about 1.0 mm. Accordingly, the dimension W of the interval portions between the housing holes 22 which is measured in the direction of the arrangement of the housing holes 22 is about 0.4 mm.

FIG. 19 illustrates a cross-sectional view illustrating, in an enlarging manner, a series of electronic components 25 formed using the carrier tape 21 illustrated in FIG. 18. In FIG. 19, components corresponding to the components illustrated in FIG. 18 are designated by the same reference characters and will not be described redundantly.

In the series of electronic components 25, a single chip-type electronic component 26 is housed in each of the housing holes 22 formed in the carrier tape 21. A top tape 27 and a bottom tape 28 are attached to the upper surface and the lower surface of the carrier tape 21, respectively, through a heat sealing method, in order to prevent the electronic components 26 housed in the housing holes 22 from falling out therefrom. The top tape 27 and the bottom tape 28 are adapted not to cover the feeding holes 23.

FIG. 20 is a view illustrating a method for fabricating the carrier tape 21 illustrated in FIG. 18, illustrating a process for forming the housing holes 22 in the tape material 29, namely a process corresponding to the process illustrated in FIG. 17(B). As illustrated in FIG. 20, when a male die 31 and a female die 32 which constitute a carrier-tape fabrication die 30 are brought close to each other, housing-hole formation convex portions 33 provided in the male die 31 are fitted into housing-hole formation concave portions 34 provided in the female die 32 while punching portions of the tape material 29, thereby forming housing holes 22 in the tape material 29.

Further, although not illustrated in FIG. 20, when the male die 31 and the female die 32 are brought close to each other with the tape material 29 sandwiched therebetween, as described above, feeding-hole formation pins are fitted into feeding-hole formation concave portion while punching portions of the tape material 29, thereby further forming feeding holes 23 in the tape material 29.

In this case, it should be noted that the housing holes 22 have the dimension L1 of about 0.6 mm which is measured in the direction of the arrangement, and the arrangement pitch P of the housing holes 22 is about 1.0 mm and, therefore, the dimension W of the interval portions 24 between the housing holes 22 is about 0.4 mm. Namely, the dimension W of the interval portions 24 between the housing holes 22 is smaller than the dimension L1 of the housing holes 22 which is measured in the direction of the arrangement.

It has been revealed that, under such conditions, the female die 32 is prone to fractures. As a cause thereof, the following fact can be estimated. When the housing-hole formation convex portions 33 in the male die 31 are pushed into the housing-hole formation concave portions 34 in the female die 32, the pushing force is transmitted to the female die 32 through the tape material 29. In this case, the smaller the dimension W of the interval portions 24 between the housing holes 22 in comparison with the dimension L1 of the housing holes 22 which is measured in the direction of the arrangement, namely the smaller the thickness T2 of the inter-concave-portion wall portions 35 positioned between adjacent housing-hole formation concave portions 34 in comparison with the thickness T1 of the housing-hole formation convex portions 33 indicated in FIG. 20, the larger the stress exerted on the female die 32 through the tape material 29 due to the pushing and, thus, the more the female die 32 is prone to fractures. Further, the smaller the thickness T2 of the inter-concave-portion wall portions 35, the smaller the strength of the inter-concave-portion wall portions 35. This also causes the increased possibility of fractures of the female die 32. FIG. 21 illustrates a side view illustrating, in an enlarging manner, an inter-concave-portion wall portion 35 formed in a member corresponding to the second member 10 illustrated in FIG. 16, in the female die 32, wherein there is a higher possibility of cracking in the direction of an arrow 36, for example.

On the other hand, in focusing attention to the form of the tape material 29, if the process illustrated in FIG. 20 is performed under the condition that the dimension W of the interval portions W between the housing holes 22 is smaller than the dimension L1 of the housing holes 22 which is measured in the direction of the arrangement, the interval portions 24 between the housing holes 22 are largely influenced by the stress applied to the tape material 29 when the housing-hole formation convex portions 33 are fitted into the housing-hole formation concave portions 34, since the dimension W of the interval portions 24 between the housing holes 22 is smaller. This may break down the form of the interval portions 24, thereby making it impossible to house the electronic components 26 within the housing holes 22 in a proper state or inducing variations in the shapes and the sizes of the plural housing holes 22. If such variations in the shapes and the sizes of the plural housing holes 22 are induced, this may induce the problem that, when the electronic components 26 are picked up through vacuum suction, for example, the electronic components 26 can not be smoothly picked up, due to variations of the suction forces.

Therefore, it is an object of the present disclosure to provide a carrier-tape fabrication die capable of suppressing the occurrence of the above-described inconvenience, and a carrier-tape fabrication method which can be implemented using the same.

The present disclosure provides a carrier-tape fabrication die for use in fabricating a carrier tape from a tape material, the carrier tape being provided with a plurality of housing holes for housing an electronic component therein in a state where the housing holes are arranged in a longitudinal direction and penetrates the carrier tape in a thickness direction. The carrier-tape fabrication die of the present disclosure includes a male die and a female die which are provided such that they can be brought close to each other and can be separated from each other, wherein correspondingly to the plurality of the housing holes to be formed, the male die has a plurality of housing-hole formation convex portions arranged therein, and the female die has a plurality of housing-hole formation concave portions arranged to receive the respective housing-hole formation convex portions, the housing-hole formation convex portions are adapted to be fitted into the housing-hole formation concave portions while punching a portion of the tape material, thereby forming the housing holes in the tape material, when the male die and the female die are brought close to each other with the tape material sandwiched therebetween.

The carrier-tape fabrication die according to the present disclosure is characterized in that it has the following structures, in order to overcome the technical problem.

The plurality of the housing-hole formation convex portions include a plurality of first housing-hole formation convex portions having a tip end at a relatively-higher heightwise position, and a plurality of second housing-hole formation convex portions having a tip end at a relatively-lower heightwise position, and the plurality of the housing-hole formation convex portions are arranged such that at least one of the second housing-hole formation convex portions is positioned between each two of the first housing-hole formation convex portions and, also, each two of the first housing-hole formation convex portions are not adjacent to each other.

With the carrier-tape fabrication die according to the present disclosure, in the process for punching the tape material with the housing-hole formation convex portions, it is possible to provide a timing difference between punchings at plural positions, in such a way as to perform punching with the first housing-hole formation convex portions and, thereafter, perform punching with the second housing-hole formation convex portions.

With the carrier-tape adopted by the present disclosure, an interval portion between the housing holes preferably has a smaller dimension than the dimension of the housing holes which is measured in a direction of arrangement of the housing holes. Such a carrier tape is more prone to induce the inconvenience and, therefore, the die according to the present disclosure is more effective therefor.

The first housing-hole formation convex portions are positioned at least at opposite ends, in the state of the arrangement of the plurality of the housing-hole formation convex portions. With this structure, it is possible to fixedly hold the tape material at first by the first housing-hole formation convex portions which have completed punching, at least at the opposite ends in the state of the arrangement of the plurality of the housing-hole formation convex portions. This enables carrying forward the subsequent punching processing in a preferable state, with all the housing-hole formation convex portions.

Preferably, the first housing-hole formation convex portions and the second housing-hole formation convex portions are alternately arranged. With this structure, it is possible to widen the intervals between the first housing-hole formation convex portions adjacent to each other by an amount corresponding to the second housing-hole formation convex portion interposed therebetween, in punching with the first housing-hole formation convex portions, over the entire region of the arrangement of the housing-hole formation convex portions. This enables implementing punching similarly to cases where the interval portions between the housing holes adjacent to each other have a relatively-larger dimension. This enables avoiding the above-described inconvenience, over the entire region of the arrangement of the housing-hole formation convex portions. In the subsequent punching with the second housing-hole formation convex portions, since the first housing-hole formation convex portions fixedly hold the tape material, in a preferably-balanced manner, in the opposite sides beside the second housing-hole formation convex portions. This enables carrying forward the punching processing in a preferable state, with the second housing-hole formation convex portions.

When the carrier tape adopted by the present disclosure includes a plurality of feeding holes arranged in parallel with the direction of the arrangement of the plurality of the housing holes, in the carrier-tape fabrication die of the present disclosure, correspondingly to the plurality of the feeding holes to be formed, the male die has a plurality of protruding feeding-hole formation pins arranged, and the female die has a plurality of feeding-hole formation concave portions arranged to receive the respective feeding-hole formation pins, the feeding-hole formation pins are adapted to be fitted into the feeding-hole formation concave portions while punching a portion of the tape material, thereby forming the feeding holes in the tape material, when the male die and the female die are brought close to each other with the tape material sandwiched therebetween, and the plurality of the feeding-hole formation pins include a pilot pin having a tip end at a higher heightwise position than the heightwise position of the tip ends of the other feeding-hole formation pins, and the pilot pin is positioned at one end in the state of the arrangement of the plurality of the feeding-hole formation pins.

With this structure, it is possible to form the feeding holes at the same time as the formation of the housing holes, which enables efficiently carrying forward the processes for forming the housing holes and the feeding holes and, also, suppresses the occurrence of errors in positioning the housing holes and the feeding holes. Furthermore, it is possible to easily and certainly perform positioning of the die and the tape material, by utilizing the pilot pin having the tip end at a higher heightwise position.

In the preferable embodiment, two pilot pins are adjacent to each other and are positioned at one end in the state of the arrangement of the plurality of the feeding-hole formation pins. With this structure, it is possible to facilitate aligning the orientations of the die and the tape material with each other.

In the present disclosure, when the female die includes a combination of a first member having a first side surface which provides a first wall surface defining the housing-hole formation concave portions, a second member which provides an inter-concave-portion wall portion positioned between the housing-hole formation convex portions adjacent to each other, and a third member having a second side surface which provides a second wall surface opposed to the first wall surface which is provided by the first side surface and defines the housing-hole formation concave portions, the inter-concave-portion wall portion is preferably provided with a rib for reinforcing it. With this structure, even when the inter-concave-portion wall portion has a smaller thickness due to reduction of the arrangement pitch of the plural housing holes, it is possible to suppress the occurrence of inconvenience such as fractures of the inter-concave-portion wall portion due to stresses exerted thereon from the male die during punching.

The present disclosure is also directed to a carrier-tape fabrication method which is implemented using the carrier-tape fabrication die.

A carrier-tape fabrication method of the present disclosure includes a process for preparing a tape material; a process for preparing the carrier-tape fabrication die of the present disclosure; a process for placing the tape material between the male die and the female die; and a process for bringing the male die and the female die close to each other for forming housing holes in the tape material.

The carrier-tape fabrication method of the present disclosure further includes a process for transferring the tape material by a predetermined distance in the longitudinal direction; wherein, when the process for placing the tape material between the male die and the female die and the process for bringing the male die and the female die close to each other for forming housing holes in the tape material are repeated by interposing the process for transferring the tape material by the predetermined distance in the longitudinal direction, the process for transferring the tape material by the predetermined distance in the longitudinal direction preferably includes transferring the tape material by the predetermined distance, such that the first housing-hole formation convex portion positioned at a starting end in the direction of transfer of the tape material, in the state of the arrangement of the plurality of the housing-hole formation convex portions, is fitted into the housing hole positioned at a termination end in the direction of transfer of the tape material. With this structure, it is possible to form the housing holes arranged at even intervals with higher accuracy, even though the tape material is intermittently transferred.

With the present disclosure, it is possible to deviate the timing of punching with the first housing-hole formation convex portions having the tip ends at a relatively-higher heightwise position, from the timing of punching with the second housing-hole formation convex portions having the tip ends at a relatively-lower heightwise position, in the process for punching the tape material with the housing-hole formation convex portions. This can temporally disperse the stress exerted on the female die, thereby suppressing the occurrence of breakages of the female die.

Further, with the present disclosure, each of two first housing-hole formation convex portions is not adjacent to each other, in addition to the above-mentioned structures. Accordingly, the pitch of the plural housing holes formed by punching with the first housing-hole formation convex portions is larger than the pitch of the plural housing holes to be formed finally, which reduces the stress (the punching resistance) exerted on the interval portions between the housing holes to be formed by the punching on the tape material with the first housing-hole formation convex portions, thereby preventing breakages of the interval portions.

On the other hand, when the second housing-hole formation convex portions are caused to punch the tape material, the first housing-hole formation convex portions are maintained at the state of being fitted in the already-formed housing holes, and the tape material is held by the first housing-hole formation convex portions, which suppresses breakages of the interval portions between the housing holes to be formed by pushing the second housing-hole formation convex portions into the tape material.

From the facts as described, with the present disclosure, it is possible to form a plurality of housing holes arranged in a tape material in a proper state, finally, without inducing breakages of interval portions, even when the pitch of the plural housing holes is smaller.

BRIEF DESCRIPTION OF THE DRAWINGS

FIG. 1 illustrates a male die 41 included in a carrier-tape fabrication die according to a first embodiment of the present disclosure, wherein

FIG. 17 is a cross-sectional view illustrating a male die 5 included in a carrier-tape fabrication die 4, and a tape material 16, together with the female die 6 illustrated in FIG. 15, wherein

DETAILED DESCRIPTION

Figure 18:
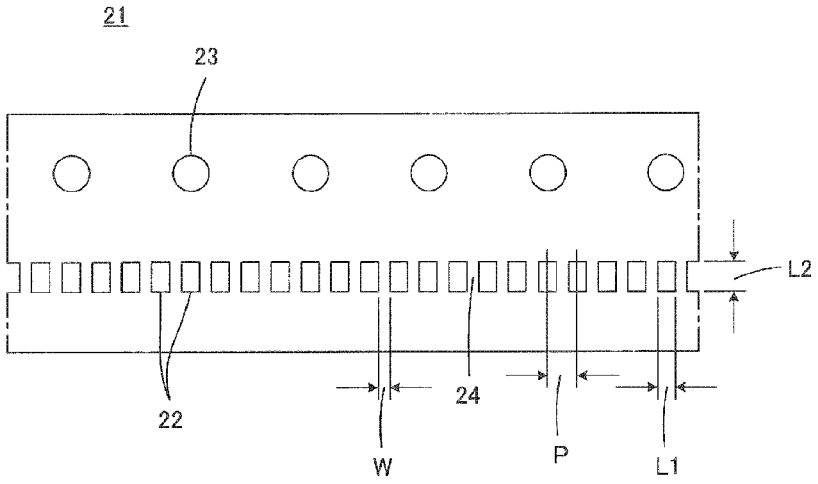
Fig. 18 Prior Art
FIG. 18 is a plan view illustrating a carrier tape 21 adapted to size reduction of electronic components, in comparison with the case of the carrier tape 1 illustrated in FIG. 14, for explaining the problem to be solved by the present disclosure.
Figure 19:
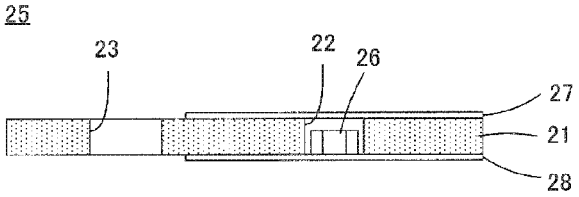
Fig. 19 Prior Art
FIG. 19 is a cross-sectional view illustrating, in an enlarging manner, a series of electronic components 25 which is formed using the carrier tape 21 illustrated in FIG. 18.

Hereinafter, there will be described embodiments for fabricating a carrier tape 21 as illustrated in FIG. 18, which satisfies the condition that the dimension W of the interval portions 24 between housing holes 22 be smaller than the dimension L1 of the housing holes 22 which is measured in the direction of the arrangement.

Figure 15:
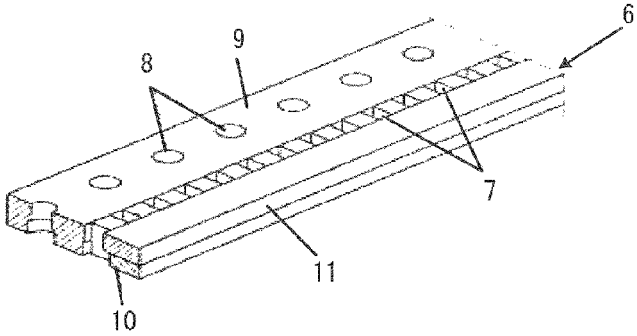
Fig. 15 Prior Art
FIG. 15 is a perspective view illustrating a female die 6 included in a conventional carrier-tape fabrication die of interest for the present disclosure.
Figure 20:
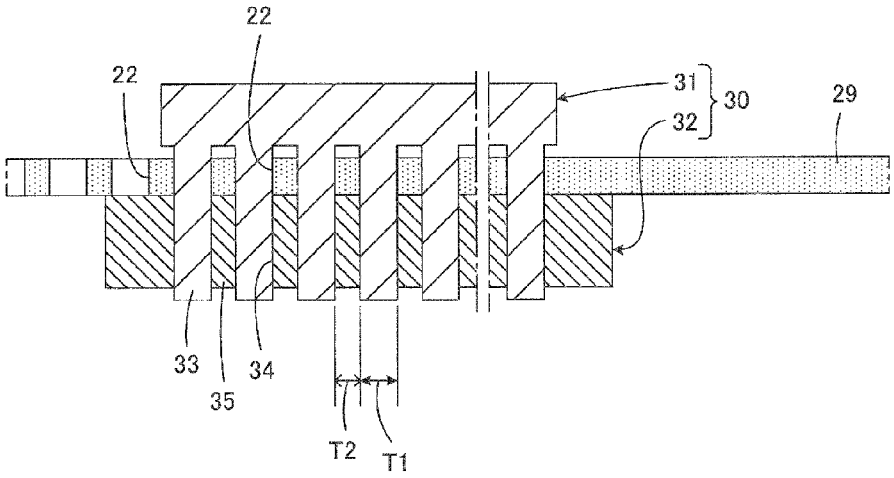
Fig. 20 Prior Art
FIG. 20 is a view illustrating a method for fabricating the carrier tape 21 illustrated in FIG. 18 and is a cross-sectional view illustrating a process for forming housing holes 22 in a tape material 29, namely a process corresponding to the process illustrated in FIG. 17(B).

FIG. 1 illustrates only a male die 41 included in a carrier-tape fabrication die, and FIGS. 2 to 6 illustrate a female die 42 which forms the carrier-tape fabrication die 40 in corporation with the male die 41 illustrated in FIG. 1, and a tape material 29 as the material of the carrier tape 21. Hereinafter, the male die 41 will be described in detail with respect to the structure thereof, but the female die 42 will not be described in detail since the female die 42 includes the same structures as those of the female die 6 described with reference to FIGS. 15 and 16 or the female die 32 illustrated in FIG. 20.

Figure 16:
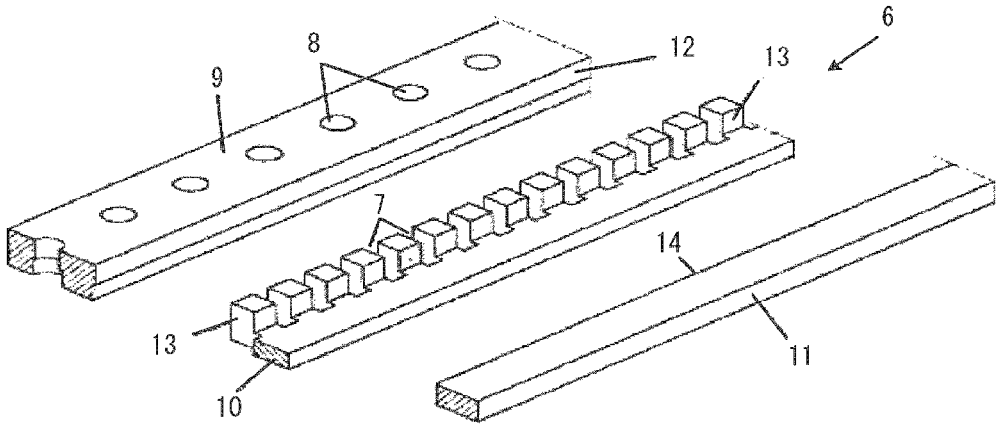
Fig. 16 Prior Art
FIG. 16 is a perspective view illustrating first to third members 9 to 11 which constitute the female die 6 illustrated in FIG. 15, in such a way as to separate them from each other.
Figure 17A:
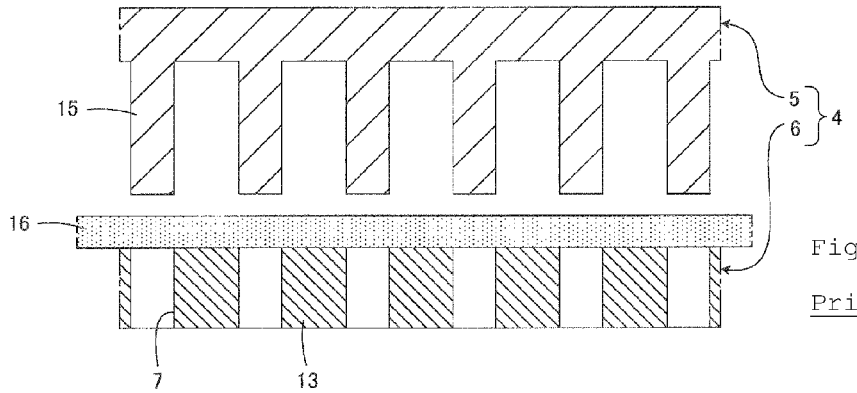
Fig. 17(A) Prior Art
FIG. 17(A) illustrates a state where the male die 5 and the female die 6 are separated from each other with the tape material 16 sandwiched therebetween.
Figure 17B:
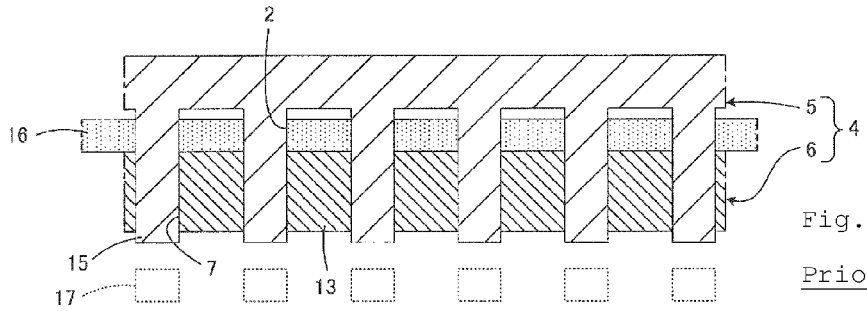
Fig. 17(B) Prior Art
FIG. 17(B) illustrates a state realized after the state illustrated in FIG. 17(A), illustrating a state after housing-hole formation convex portions 15 included in the male die 5 have punched the tape material 16.
Figure 17C:
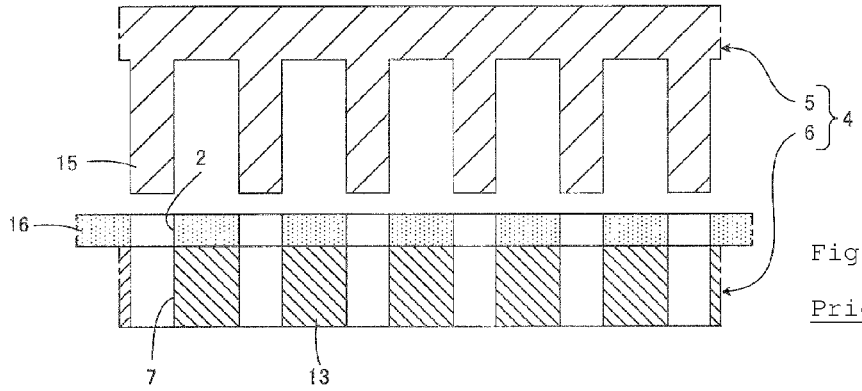
Fig. 17(C) Prior Art
FIG. 17(C) illustrates a state realized after the state illustrated in FIG. 17(B), illustrating a state where the male die 5 has been separated from the female die 6 after the formation of housing holes 2 in the tape material 16.

Briefly, the female die 42 has a three-split structure similar to that illustrated in FIG. 16 and includes a plurality of housing-hole formation concave portions 43 arranged therein, as illustrated in FIGS. 2 to 6. The shape and the arrangement pitch of the housing-hole formation concave portions 43 correspond to the shape and the arrangement pitch of the housing holes 22 included in the carrier tape 21 illustrated in FIG. 18. Further, although not illustrated, the female die 42 is provided with feeding-hole formation concave portions corresponding to the feeding-hole formation concave portions 8 illustrated in FIG. 15. The shape and the arrangement pitch of the feeding-hole formation concave portions correspond to the shape and the arrangement pitch of the feeding holes 23 included in the carrier tape 21.

With reference mainly to FIG. 1, the male die 41 includes a head base 44. There are provided pluralities of feeding-hole formation pins 45 and 46 which are arranged, in such a way as to protrude from the head base 44. Further, a protruding table 47 is provided on the head base 44, and there are provided pluralities of housing-hole formation convex portions 48 and 49 in such a way as to protrude from the protruding table 47.

The housing-hole formation convex portions 48 and 49 are to be received by the housing-hole formation concave portions 43 (see FIGS. 2 to 6) which are provided in the female die 42. The housing-hole formation convex portions 48 and 49 are sorted into first housing-hole formation convex portions 48 having respective tip ends at a relatively-higher heightwise position, and second housing-hole formation convex portions 49 having respective tip ends at a relatively-lower heightwise position. The aspect of the arrangement of the pluralities of the housing-hole formation convex portions 48 and 49 is selected, such that at least a single second housing-hole formation convex portion 49 is positioned between two first housing-hole formation convex portions 48 and, also, two first housing-hole formation convex portions 48 are not adjacent to each other.

Particularly, in the present embodiment, first housing-hole formation convex portions 48 are positioned at least at the opposite ends, in the state of the arrangement of the pluralities of the housing-hole formation convex portions and 49. Further, in the present embodiment, the first housing-hole formation convex portions 48 and the second housing-hole formation convex portions 49 are alternately arranged.

The difference H between the heightwise positions of the first housing-hole formation convex portions 48 and the second housing-hole formation convex portions 49 is preferably equal to or more than half the thickness of the tape material 29 and is more preferably equal to the thickness of the tape material 29. When the thickness of the tape material 29 is about 0.5 mm as described above, it is more preferable that the difference H between the heightwise positions is about 0.5 mm. This is for the following reasons. If the difference H between the heightwise positions of the first housing-hole formation convex portions 48 and the second housing-hole formation convex portions 49 is too small, this makes it harder to reduce the stress applied to the tape material 29. If the difference H is too large, this causes the first housing-hole formation convex portions 48 to be pushed by a larger amount, thereby increasing the stress applied to the tape material 29.

As described above, in the carrier tape 21 illustrated in FIG. 18, the housing holes 22 has the dimension L1 of about 0.6 mm which is measured in the direction of the arrangement, and the dimension L2 of about 1.1 mm which is measured in the direction orthogonal to the direction of the arrangement, and the dimension W of the interval portions 24 between the housing holes 22 is about 0.4 mm. Therefore, the housing-hole formation convex portions 48 and 49 also has a cross-sectional dimension S1 of about 0.6 mm which is measured in the direction of the arrangement, and a cross-sectional dimension S2 of about 1.1 mm which is measured in the direction orthogonal to the direction of the arrangement, and the interval S3 between the housing-hole formation convex portions 48 and 49 is about 0.4 mm.

Figure 1A:
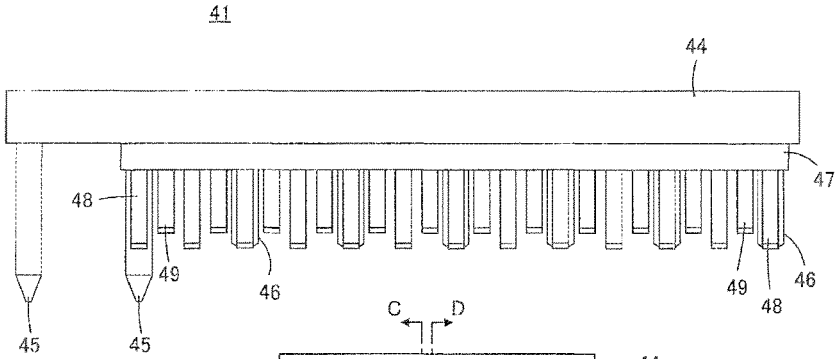
FIG. 1(A) is a front view of the same.
Figure 1B:
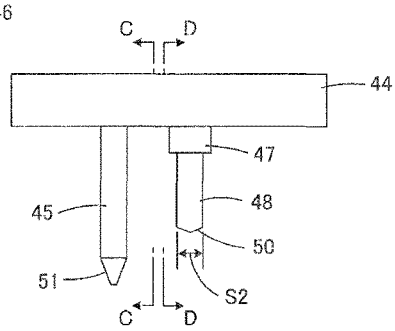
FIG. 1(B) is a left side view of the same.
Figure 1C:
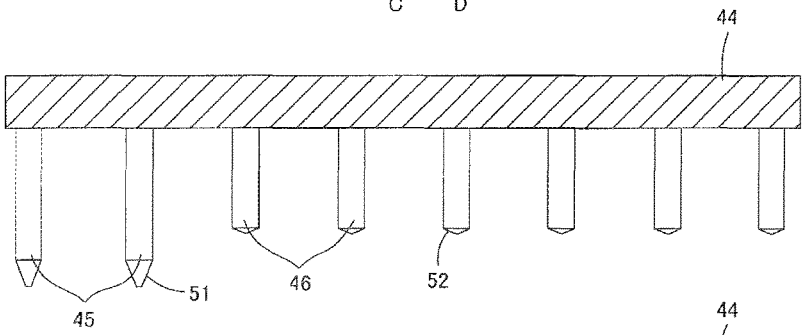
FIG. 1(C) is a cross-sectional view of the same taken along the line C-C in FIG. 1(B)
Figure 1D:
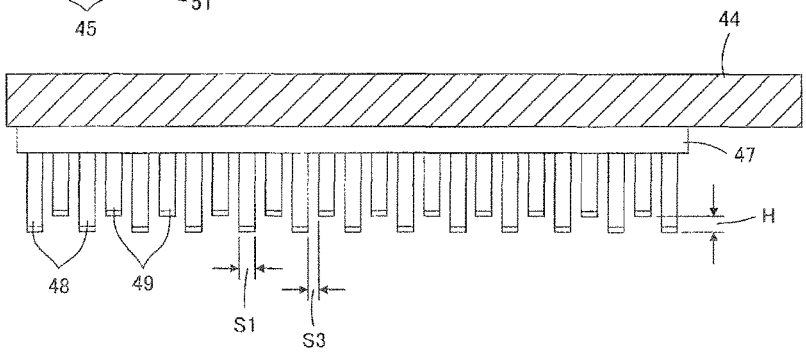
FIG. 1(D) is a cross-sectional view of the same taken along the line D-D in FIG. 1(B).

Further, as well illustrated in FIG. 1(B) regarding the first housing-hole formation convex portions 48, it is preferable that the housing-hole formation convex portions 48 and 49 are provided with tapered surfaces 50 at their respective tip ends.

Although not illustrated, the feeding-hole formation pins 45 and 46 are to be received by feeding-hole formation concave portions provided in the female die 42. In the carrier tape 21 illustrated in FIG. 18, the feeding holes are arranged at even intervals at a rate of a single feeding hole 23 per four housing holes 22 and, therefore, the feeding-hole formation pins 45 and 46 are arranged at even intervals at a rate of a single feeding-hole formation pin 45 or 46 per four first and second housing-hole formation convex portions 48 and 49 in total.

Out of the feeding-hole formation pins 45 and 46, the two feeding-hole formation pins 45 positioned at one end in this arrangement state are made to have respective tip ends at a heightwise position which is higher than the heightwise position of the tip ends of the other feeding-hole formation pins 46. These feeding-hole formation pins 45 having the tip ends at the higher heightwise position are to form pilot pins for facilitating the positioning of the die 40 and the tape material 29. Hereinafter, the feeding-hole formation pins 45 will be referred to as "pilot pins 45", in some cases.

Only the endmost single feeding-hole formation pin, out of the feeding-hole formation pins 45 and 46 in the arranged state, may be made to be a pilot pin 45. However, in the present embodiment, the two feeding-hole formation pins adjacent to each other at the end in the arrangement state are made to be pilot pins 45. With this structure, it is possible to facilitate aligning the orientations of the die 40 and the tape material 29 with each other.

It is preferable that the other feeding-hole formation pins 46 than the pilot pins 45 have respective tip ends at a heightwise position equal to the heightwise position of the tip ends of the first housing-hole formation convex portions 48, as can be seen in FIG. 1(A).

The pilot pins 45 are preferably provided with respective conical surfaces 51 at their tip ends. Further, the feeding-hole formation pins 46 are preferably provided with respective conical surfaces 52 with a relatively-larger vertex angle, at their tip ends.

Next, with reference to FIGS. 2 to 6, there will be described a method for fabricating the carrier tape 21, which is implemented using the carrier-tape fabrication die 40.

Figure 2:
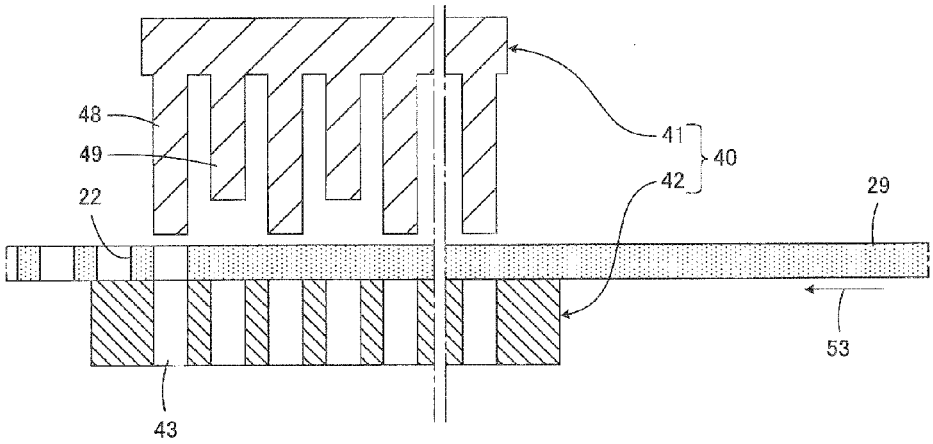
FIG. 2 is a cross-sectional view illustrating a female die 42 which constitutes the carrier-tape fabrication die 40 in cooperation with the male die 41 illustrated in FIG. 1, and a tape material 29, illustrating a state where the male die 41 and the female die 42 are separated from each other with the tape material 29 sandwiched therebetween.

As illustrated in FIG. 2, in order to fabricate the carrier tape 21, the tape material 29, which is made of a cardboard, for example, is prepared, and the tape material 29 is placed between the male die 41 and the female die 42. In FIG. 2, there is illustrated the tape material 29 in which some housing holes 22 have been already formed. In this case, in a process illustrated in FIG. 2, it is preferable to perform positioning thereof, such that a first housing-hole formation convex portion 48 positioned at the starting end in the transfer direction 53, out of the pluralities of housing-hole formation convex portions 48 and 49 in the arranged state, is fitted into the housing hole 22 positioned at the termination end in the transfer direction 53 of the tape material 29.

Figure 3:
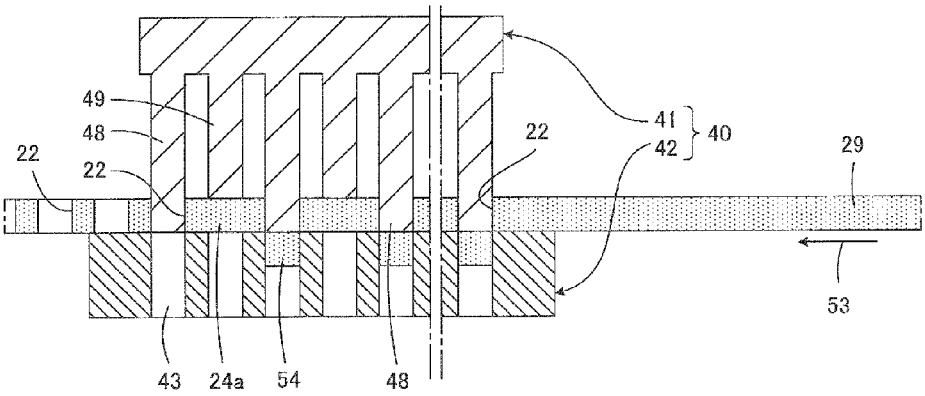
FIG. 3 illustrates a state realized after the state illustrated in FIG. 2, illustrating a state after first housing-hole formation convex portions 48 included in the male die 41 have been caused to punch the tape material 29.

Next, the male die 41 and the female die 42 are brought close to each other. In a former-half step in this process for bringing them close to each other, as illustrated in FIG. 3, only the first housing-hole formation convex portions 48 included in the male die 41 are caused to punch portions of the tape material 29, thereby forming housing holes 22 in the tape material 29. In the step illustrated in FIG. 3, as a result of the formation of the housing holes 22, the punched pieces 54 resulted from the punching on the tape material 29 remain within the housing-hole formation concave portions 43.

The first housing-hole formation convex portions 48 positioned at the starting end in the transfer direction 53, out of the pluralities of the housing-hole formation convex portions 48 and 49 in the arranged state, has been fitted in the housing hole 22 positioned at the termination end in the transfer direction 53 of the tape material 29, which has been formed in the previous process. This enables forming the housing holes 22 arranged at even intervals with higher accuracy.

In the process illustrated in FIG. 3, only the first housing-hole formation convex portions 48 having the respective tip ends at the relatively-higher heightwise position are caused to punch the tape material 29. Accordingly, in comparison with cases where all the first and second housing-hole formation convex portions 48 and 49 are caused to perform punching operations at the same time, it is possible to reduce the stress exerted on the female die 42, thereby suppressing the occurrence of fractures of the female die 42.

Further, in the process illustrated in FIG. 3, the pitch of the plural housing holes 22 formed by the punching with the first housing-hole formation convex portions 48 is larger than the pitch of the plural housing holes 22 to be formed finally. This reduces the stress exerted on the interval portions 24*a* between the housing holes 22 to be formed by the punching on the tape material 29 with the first housing-hole formation convex portions 48, thereby preventing breakages of the interval portions 24*a*.

Further, although not illustrated in FIG. 3, when the male die 41 and the female die 42 are brought close to each other with the tape material 29 sandwiched therebetween, as described above, the feeding-hole formation pins 45 and 46 are caused to punch portions of the tape material 29, thereby further forming feeding holes 23. At this time, the two pilot pins 45 positioned at the starting end in the transfer direction 53 are positioned, such that they are fitted into the two feeding holes 23 positioned at the termination end in the transfer direction 53, which have been formed in the previous process. Accordingly, this also contributes to the formation of the plural housing holes 22 in a state where they are arranged at even intervals with higher accuracy. In addition thereto, this also contributes to aligning the orientations of the die 40 and the tape material 29 with each other.

Figure 4:
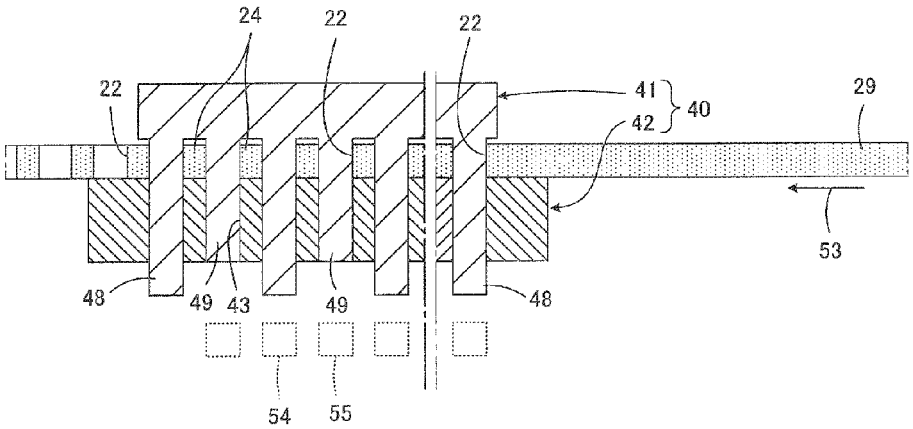
FIG. 4 illustrates a state realized after the state illustrated in FIG. 3, illustrating a state after second housing-hole formation convex portions 49 included in the male die 41 have been caused to punch the tape material 29.

Next, as illustrated in FIG. 4, the male die 41 and the female die 42 are further brought closer to each other and, then, the first housing-hole formation convex portions 48 are fitted into the housing-hole formation concave portions 43, and their tip ends pass through the housing-hole formation concave portions 43. This causes the punched pieces 54 to be discharged from the housing-hole formation concave portions 43 as indicated by broken lines.

On the other hand, the second housing-hole formation convex portions 49 are fitted into the housing-hole formation concave portions 43 while punching portions of the tape material 29, thereby forming housing holes 22 in the tape material 29. In FIG. 4, the broken lines also indicate the punched pieces 55 formed by the punching on the tape material 29, as a result of the formation of the housing holes 22 with the second housing-hole formation convex portions 49.

In the process illustrated in FIG. 4, when the second housing-hole formation convex portions 49 are caused to punch the tape material 29, the first housing-hole formation convex portions 28 are maintained at the state where they are fitted in the already-formed housing holes 22, and the tape material 29 is held by the first housing-hole formation convex portions 48, which suppresses breakages of the interval portions 24 between the housing holes 22 to be formed by pushing the second housing-hole formation convex portions 49 into the tape material 29.

Further, although not illustrated in FIG. 4, the punched pieces resulted from the formation of the feeding holes 23 by the feeding-hole formation pins 45 and 46 are also discharged from the feeding-hole formation concave portions.

Figure 5:
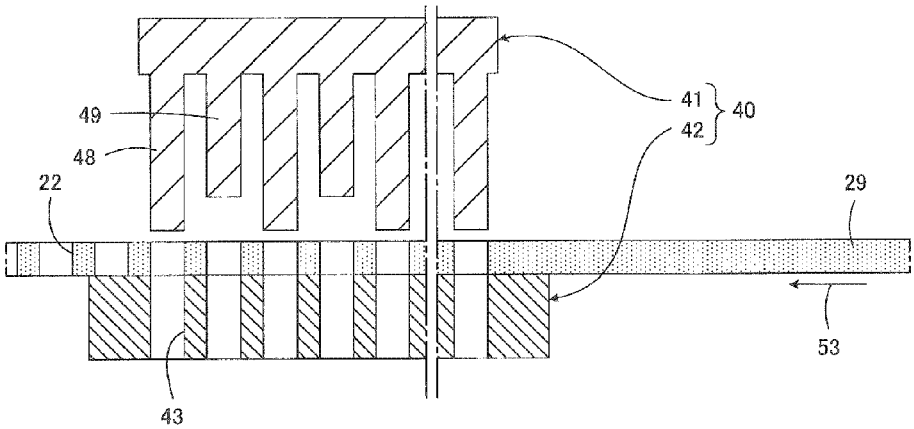
FIG. 5 illustrates a state realized after the state illustrated in FIG. 4, illustrating a state where the male die 41 has been separated from the female die 42, after the formation of housing holes 22 in the tape material 29.

Next, as illustrated in FIG. 5, the male die 41 and the female die 42 are returned to a state where they are separated from each other. A plurality of housing holes 22 and a plurality of feeding holes 23, which are not illustrated, are formed in the tape material 29 placed on the female die 42.

Figure 6:
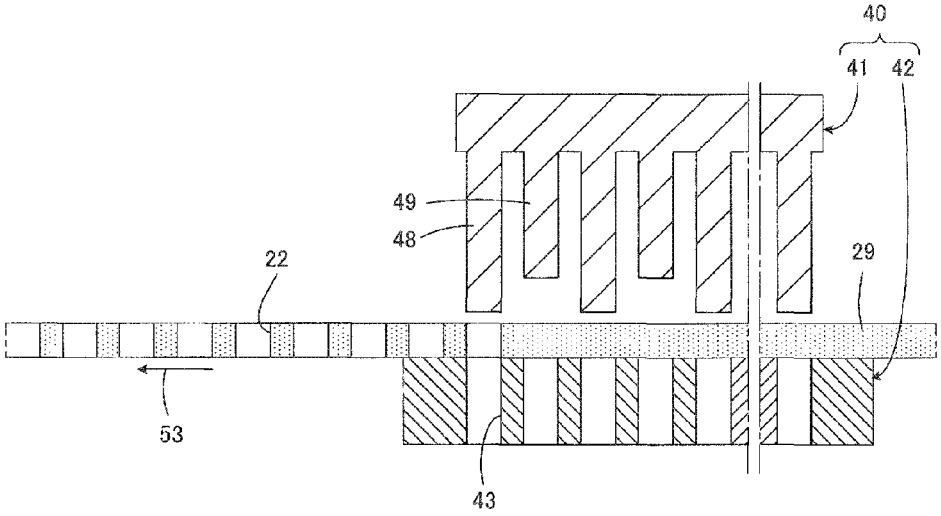
FIG. 6 illustrates a state realized after the state illustrated in FIG. 5, illustrating a state after the tape material 29 has been transferred by a predetermined distance in the longitudinal direction, in preparation for the subsequent punching process.

Next, as illustrated in FIG. 6, the tape material 29 is transferred by a predetermined distance in the longitudinal direction. As a result of this intermittent transfer, the tape material 29 is positioned, such that the first housing-hole formation convex portion 48 positioned at the starting end in the transfer direction 53, out of the pluralities of housing-hole formation convex portions 48 and 49 in the arranged state, is fitted into the housing hole 22 positioned at the termination end in the transfer direction 53 of the tape material 29. By doing this, the interval between the housing hole 22 positioned at the termination end in the transfer direction 53 of the tape material 29 and the housing hole 22 to be newly formed can be made equal to the intervals between the other housing holes 22. Further, it is possible to facilitate aligning the male die 41 with the longitudinal direction of the tape material 29. Further, although not illustrated in FIG. 6, the two pilot pins 45 positioned at the starting end in the transfer direction 53 are positioned, such that they are fitted into the two feeding holes 23 positioned at the termination end in the transfer direction 53, which have been formed in the previous process.

Thereafter, each of the processes illustrated in FIGS. 2 to 5 are repeated by interposing the process for transferring the tape material 29 which is illustrated in FIG. 6, so that the carrier tape 21 as illustrated in FIG. 18 is fabricated.

Hereinafter, other embodiments of the present disclosure will be described.

FIGS. 7 to 12 illustrate examples of modifications of the male die 41, as second to seventh embodiments of the present disclosure. In FIGS. 7 to 12, components corresponding to the components illustrated in FIG. 2 and the like are designated by the same reference characters and will not be described redundantly.

Figure 7:
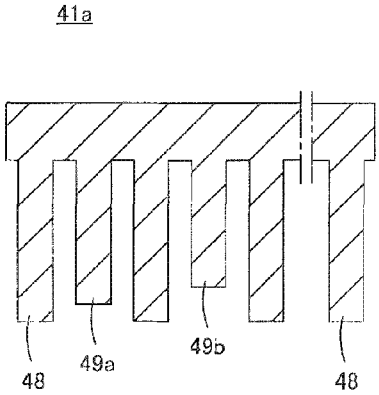
FIG. 7 is a cross-sectional view illustrating a male die 41*a* included in a carrier-tape fabrication die according to a second embodiment of the present disclosure.

FIG. 7 illustrates a male die 41*a* which is characterized in that it includes at least two types of second housing-hole formation convex portions 49*a* and 49*b* having respective tip ends at heightwise positions different from each other, as second housing-hole formation convex portions having respective tip ends at a relatively-lower heightwise position.

Figure 8:
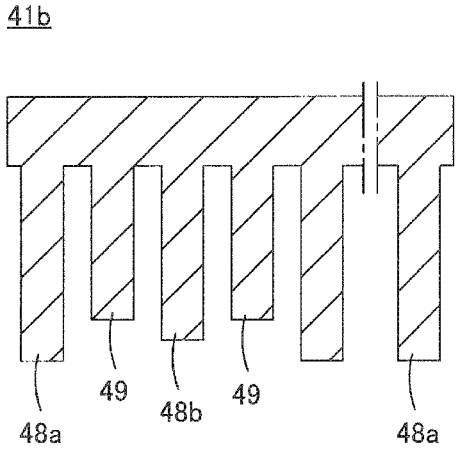
FIG. 8 is a cross-sectional view illustrating a male die 41*b* included in a carrier-tape fabrication die according to a third embodiment of the present disclosure.

FIG. 8 illustrates a male die 41*b* which is characterized in that it includes at least two types of first housing-hole formation convex portions 48*a* and 48*b* having respective tip ends at heightwise positions different from each other, as first housing-hole formation convex portions having respective tip ends at a relatively-higher heightwise position.

Figure 9:
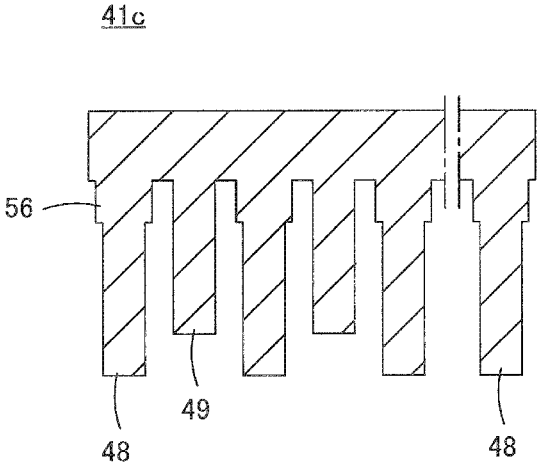
FIG. 9 is a cross-sectional view illustrating a male die 41*c* included in a carrier-tape fabrication die according to a fourth embodiment of the present disclosure.

FIG. 9 illustrates a male die 41*c* which includes first and second housing-hole formation convex portions 48 and with respective tip ends having the same heightwise-positional relationship as that of the male die 41 illustrated in FIG. 2 and the like, but is characterized in that the first housing-hole formation convex portions 48 are provided, at their base portions, with respective sleeve portions 56 having a relatively-larger diameter and are made to have the same lengthwise dimension as that of the second housing-hole formation convex portions 49 at the other portions than the sleeve portions 56.

Figure 10:
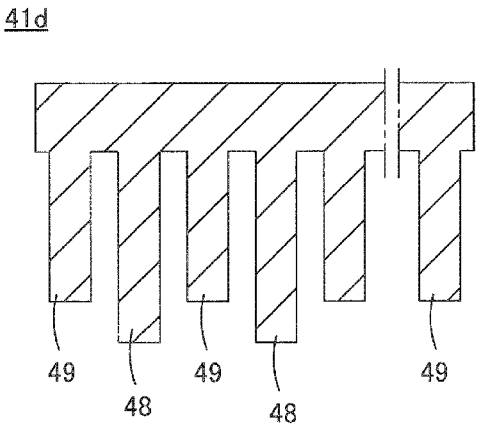
FIG. 10 is a cross-sectional view illustrating a male die 41*d* included in a carrier-tape fabrication die according to a fifth embodiment of the present disclosure.

FIG. 10 illustrates a male die 41*d* which is characterized in that second housing-hole formation convex portions 49 are positioned at least at the opposite ends, in a state of arrangement of the housing-hole formation convex portions 48 and 49.

Figure 11:
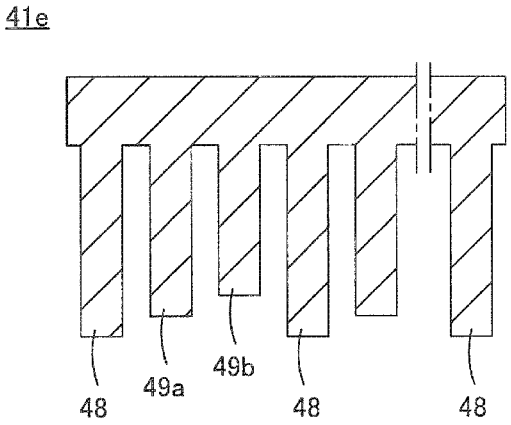
FIG. 11 is a cross-sectional view illustrating a male die 41*e* included in a carrier-tape fabrication die according to a sixth embodiment of the present disclosure.

FIG. 11 illustrates a male die 41*e* which is characterized in that it includes at least two types of second housing-hole formation convex portions 49*a* and 49*b* having respective tip ends at heightwise positions different from each other, as second housing-hole formation convex portions having respective tip ends at a relatively-lower heightwise position, and these two second housing-hole formation convex portions 49*a* and 49*b* are adjacent to each other and are positioned between first housing-hole formation convex portions 48.

Figure 12:
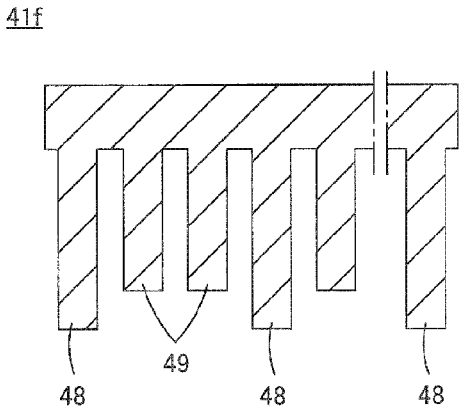
FIG. 12 is a cross-sectional view illustrating a male die 41*f* included in a carrier-tape fabrication die according to a seventh embodiment of the present disclosure.

FIG. 12 illustrates a male die 41*f* which is characterized in that two second housing-hole formation convex portions 49 are adjacent to each other and are positioned between first housing-hole formation convex portions 48.

These male dies 41*a* to 41*f* illustrated in FIGS. 7 to 12 all satisfy a first condition that a plurality of housing-hole formation convex portions be arranged such that at least a single second housing-hole formation convex portion is positioned between two first housing-hole formation convex portions and, also, the two first housing-hole formation convex portions are not adjacent to each other, similarly to the male die 41 illustrated in FIG. 2 and the like.

When the first condition is satisfied, it is possible to deviate the timing of punching with the first housing-hole formation convex portions having the respective tip ends at a relatively-higher heightwise position from the timing of punching with the second housing-hole formation convex portions having the respective tip ends at a relatively-lower heightwise position, in the process for punching the tape material with the housing-hole formation convex portions. This can disperse the stress exerted on the female die, thereby suppressing the occurrence of fractures of the female die. Further, even when the pitch of the plural housing holes is smaller, it is possible to form the plural housing holes arranged, in a proper state, without inducing breakages of the interval portions.

Particularly, the male die 41*a* illustrated in FIG. 7, the male die 41*b* illustrated in FIG. 8, the male die 41*c* illustrated in FIG. 9, the male die 41*e* illustrated in FIG. 11 and the male die 41*f* illustrated in FIG. 12 satisfy a second condition that the first housing-hole formation convex portions are positioned at least at the opposite ends, in the state of arrangement of the plural housing-hole formation convex portions.

When the second condition is satisfied, it is possible to fixedly hold the tape material at first by the first housing-hole formation convex portions which have completed punching, at least at the opposite ends in the state of the arrangement of the plural housing-hole formation convex portions. This enables carrying forward the subsequent punching processing, in a preferable state, with all the housing-hole formation convex portions.

Further, the male die 41*a* illustrated in FIG. 7, the male die 41*b* illustrated in FIG. 8, the male die 41*c* illustrated in FIG. 9, and the male die 41*d* illustrated in FIG. 10 satisfy a third condition that the first housing-hole formation convex portions and the second housing-hole formation convex portions are alternately arranged.

When the third condition is satisfied, it is possible to widen the interval between first housing-hole formation convex portions adjacent to each other by an amount corresponding to the second housing-hole formation convex portion interposed therebetween, in punching with the first housing-hole formation convex portions, over the entire region of the arrangement of the housing-hole formation convex portions. This enables implementing punching similarly to cases where the interval portions between housing holes adjacent to each other have a relatively-larger dimension. In the subsequent punching with the second housing-hole formation convex portions, since the first housing-hole formation convex portions fixedly hold the tape material, in a preferably-balanced manner, in the opposite sides beside the second housing-hole formation convex portions. This enables carrying forward the punching processing in a preferable state, with the second housing-hole formation convex portions.

Figure 13:
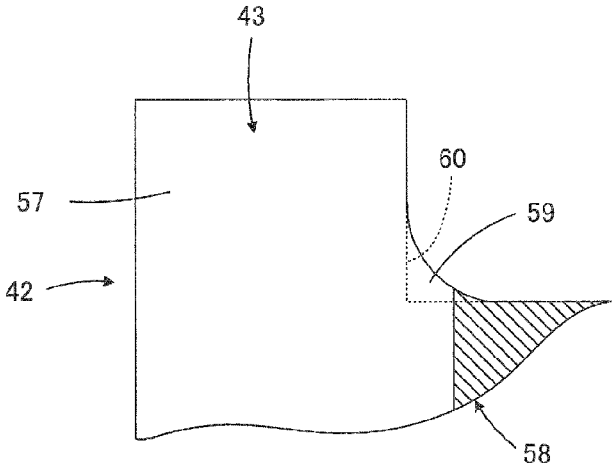
FIG. 13 is a side view illustrating, in an enlarging manner, an inter-concave-portion wall portion 57 included in a carrier-tape fabrication die according to an eighth embodiment of the present disclosure.
Figure 14:
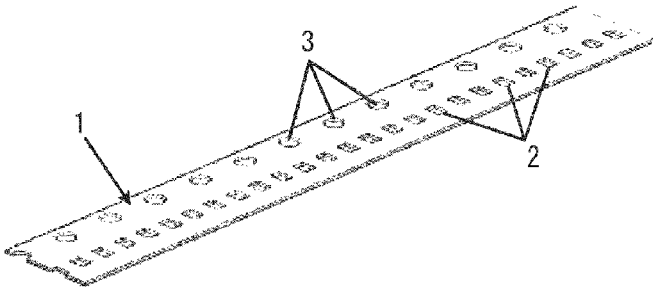
Fig. 14 Prior Art
FIG. 14 is a perspective view illustrating a conventional carrier tape 1 of interest for the present disclosure.
Figure 21:
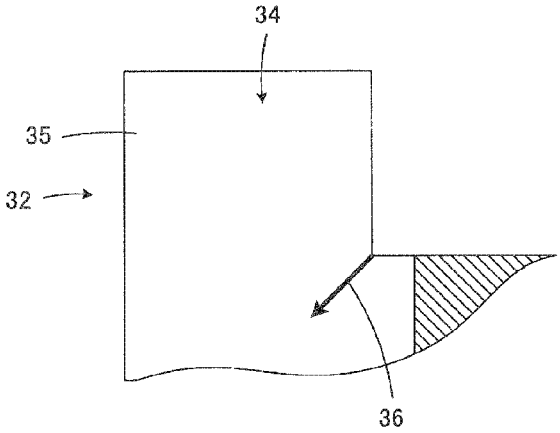
Fig. 21 Prior Art
FIG. 21 is a side view illustrating, in an enlarging manner, an inter-concave-portion wall portion 35 in a female die 32, schematically illustrating the direction of cracking which may be induced when the process illustrated in FIG. 20 is implemented.

FIG. 13 is a side view illustrating, in an enlarging manner, an inter-concave-portion wall portion 57 formed between housing-hole formation concave portions 43 adjacent to each other, in a female die, illustrating an eighth embodiment of the present disclosure. FIG. 13 is a view corresponding to FIG. 21.

In FIG. 13, there is illustrated a second member 58 which corresponds to the second member 10, in a female die having a three-split structure as illustrated in FIG. 16. This female die is constituted by a combination of a first member having a first side surface which provides a first wall surface defining the housing-hole formation concave portions 43, the second member 58 which provides the inter-concave-portion wall portions 57 positioned between the housing-hole formation concave portions 43 adjacent to each other, and a third member having a second side surface which provides a second wall surface opposed to the first wall surface which is provided by the first side surface and defines the housing-hole formation concave portions 43, similarly to the female die 6 illustrated in FIGS. 15 and 16.

The present embodiment is characterized in that the inter-concave-portion wall portions 57 are provided with a rib 59 for reinforcing them. In FIG. 13, a broken line 60 indicates the contour of the inter-concave-portion wall portion 57 in the case where it is not provided with the rib 59, in order to clearly illustrate the presence of the rib 59.

As described above, by providing the rib 59, even when the inter-concave-portion wall portions 57 have a smaller thickness, due to reduction of the arrangement pitch of the plural housing holes 22, it is possible to suppress the occurrence of malfunctions such as fractures of the inter-concave-portion wall portions 57, due to stresses exerted thereon from the male die during punching.

Further, although, in FIG. 13, the rib 59 is formed to have a cylindrical surface with a rounded inclined surface, it can also have a simple flat surface, instead of a cylindrical surface.

Further, although the embodiment illustrated in FIG. 13 is based on the premise that the female die has a three-split structure, the carrier-tape fabrication die according to the present disclosure can also include a female die having an integrated structure.

Further, the present disclosure can be also applied to fabrication of carrier tapes having other dimensional relationships, as well as fabrication of the carrier tape 21 illustrated in FIG. 18, as a matter of course.

What is claimed is:

1. A carrier-tape fabrication method comprising:

preparing a tape material;

preparing a carrier-tape fabrication die for use in fabricating a carrier tape from the tape material, the carrier tape being provided with a plurality of housing holes for housing an electronic component therein in a state where the housing holes are arranged in a longitudinal direction and penetrates the carrier tape in a thickness direction, including a male die and a female die which are provided such that the male die and the female die are brought together and separated from each other;

the male die having a plurality of housing-hole formation convex portions arranged therein corresponding to the plurality of the housing holes to be formed, and the female die having a plurality of housing-hole formation concave portions arranged to receive the respective housing-hole formation convex portions;

the housing-hole formation convex portions being adapted to be fitted into the housing-hole formation concave portions while punching a portion of the tape material, thereby forming the housing holes in the tape material, when the male die and the female die are brought into engagement with each other with the tape material sandwiched therebetween;

the plurality of housing-hole formation convex portions including a plurality of first housing-hole formation convex portions having a tip end at a relatively-higher heightwise position, and a plurality of second housing-hole formation convex portions having a tip end at a relatively-lower heightwise position; and the plurality of housing-hole formation convex portions being arranged such that at least one of the second housing-hole formation convex portions is positioned between the two first housing-hole formation convex portions and the two first housing-hole formation convex portions are spaced from each other, wherein an interval portion between the housing holes has a smaller dimension than a dimension of the housing holes measured in a direction of arrangement of the housing holes, the carrier tape includes a plurality of feeding holes arranged in parallel with the longitudinal direction of the arrangement of the plurality of the housing holes, the male die has a plurality of protruding feeding-hole formation pins arranged therein corresponding to the plurality of the feeding holes to be formed, and the female die has a plurality of feeding-hole formation concave portions arranged to receive the respective feeding-hole formation pins, the feeding-hole formation pins are adapted to be fitted into the feeding-hole formation concave portions while punching a portion of the tape material, thereby forming the feeding holes in the tape material, when the male die and the female die are brought into engagement with each other with the tape material sandwiched therebetween, and the plurality of the feeding-hole formation pins include a pilot pin having a tip end at a higher heightwise position than a heightwise position of the tip ends of the other feeding-hole formation pins, and the pilot pin is positioned at one end of the plurality of feeding-hole formation pins;

placing the tape material between the male die and the female die; and bringing the male die and the female die into engagement with other for forming housing holes in the tape material.

2. The carrier-tape fabrication method according to claim 1, further comprising transferring the tape material by a predetermined distance in a longitudinal direction;

wherein the steps of placing the tape material between the male die and the female die and bringing the male die and the female die into engagement with other for forming housing holes in the tape material are repeated after transferring the tape material by the predetermined distance in the longitudinal direction, and the transferring of the tape material by the predetermined distance in the longitudinal direction includes transferring the tape material such that the first housing-hole formation convex portion positioned at a starting end, in the transfer direction of the tape material, of the plurality of housing-hole formation convex portions, is fitted into the housing hole positioned at a termination end in the transfer direction of the tape material.

3. A carrier-tape fabrication die for use in fabricating a carrier tape from a tape material, the carrier tape being provided with a plurality of housing holes for housing an electronic component therein in a state where the housing holes are arranged in a longitudinal direction and penetrates the carrier tape in a thickness direction, the carrier-tape fabrication die comprising:

a male die and a female die which are provided such that the male die and the female die are brought together and separated from each other;

the male die having a plurality of housing-hole formation convex portions arranged therein corresponding to the plurality of the housing holes to be formed, and the female die having a plurality of housing-hole formation concave portions arranged to receive the respective housing-hole formation convex portions;

the housing-hole formation convex portions being adapted to be fitted into the housing-hole formation concave portions while punching a portion of the tape material, thereby forming the housing holes in the tape material, when the male die and the female die are brought into engagement with each other with the tape material sandwiched therebetween;

the plurality of housing-hole formation convex portions including a plurality of first housing-hole formation convex portions having a tip end at a relatively-higher heightwise position, and a plurality of second housing-hole formation convex portions having a tip end at a relatively-lower heightwise position; and the plurality of housing-hole formation convex portions being arranged such that at least one of the second housing-hole formation convex portions is positioned between the two first housing-hole formation convex portions and the two first housing-hole formation convex portions being spaced from each other, wherein an interval portion between the housing holes has a smaller dimension than a dimension of the housing holes measured in a direction of arrangement of the housing holes, the carrier tape includes a plurality of feeding holes arranged in parallel with the longitudinal direction of the arrangement of the plurality of the housing holes, the male die has a plurality of protruding feeding-hole formation pins arranged therein corresponding to the plurality of the feeding holes to be formed, and the female die has a plurality of feeding-hole formation concave portions arranged to receive the respective feeding-hole formation pins, the feeding-hole formation pins are adapted to be fitted into the feeding-hole formation concave portions while punching a portion of the tape material, thereby forming the feeding holes in the tape material, when the male die and the female die are brought into engagement with each other with the tape material sandwiched therebetween, and the plurality of the feeding-hole formation pins include a pilot pin having a tip end at a higher heightwise position than a heightwise position of the tip ends of the other feeding-hole formation pins, and the pilot pin is positioned at one end of the plurality of feeding-hole formation pins.

4. The carrier-tape fabrication die according to claim 3, wherein the first housing-hole formation convex portions are positioned at least at opposite ends of the plurality of the housing-hole formation convex portions.

5. The carrier-tape fabrication die according to claim 3, wherein the first housing-hole formation convex portions and the second housing-hole formation convex portions are alternately arranged.

6. The carrier-tape fabrication die according to claim 3, wherein two pilot pins are adjacent to each other and are positioned at one end of the plurality of the feeding-hole formation pins.

7. The carrier-tape fabrication die according to claim 3, wherein the female die includes a combination of a first member having a first side surface which provides a first wall surface defining the housing-hole formation concave portions, a second member which provides an inter-concave-portion wall portion positioned between the housing-hole formation convex portions adjacent to each other, and a third member having a second side surface which provides a second wall surface opposed to the first wall surface which is provided by the first side surface and defines the housing-hole formation concave portions, and the inter-concave-portion wall portion is provided with a rib for reinforcing the inter-concave-portion wall portion.

* * * * *